US009958804B2

(12) United States Patent
Matsuda et al.

(10) Patent No.: US 9,958,804 B2
(45) Date of Patent: May 1, 2018

(54) IMAGE FORMING APPARATUS AND IMAGE PROCESSING APPARATUS

(71) Applicant: CANON KABUSHIKI KAISHA, Tokyo (JP)

(72) Inventors: Yuu Matsuda, Suntou-gun (JP); Go Araki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/352,276

(22) Filed: Nov. 15, 2016

(65) Prior Publication Data

US 2017/0139343 A1 May 18, 2017

(30) Foreign Application Priority Data

Nov. 17, 2015 (JP) ..... 2015-225088

(51) Int. Cl.
*G03G 15/043* (2006.01)

(52) U.S. Cl.
CPC ..... *G03G 15/043* (2013.01)

(58) Field of Classification Search
CPC ..... G03G 15/043; G03G 15/556; G06K 15/1867; H04N 1/00
See application file for complete search history.

(56) References Cited

FOREIGN PATENT DOCUMENTS

| | | | |
|---|---|---|---|
| JP | 10-145600 | A | 5/1998 |
| JP | 2000-043315 | A | 2/2000 |
| JP | 2010-192962 | A | 9/2010 |
| JP | 2013-048395 | A | 3/2013 |
| JP | 2014-165776 | A | 9/2014 |

*Primary Examiner* — Christopher D Wait
(74) *Attorney, Agent, or Firm* — Canon U.S.A., Inc. IP Division

(57) ABSTRACT

An image forming apparatus includes an identifying unit configured to identify on basis of image data, a pixel to be corrected from a plurality of pixels of an image to be formed from the image data, a holding unit configured to hold a plurality of correction information pieces describing correction amounts for exposure amounts, and a correcting unit configured to select a correction information piece from the plurality of correction information pieces on basis of distances between one of the pixels to be corrected and a plurality of edges of the image formed from the image data and to correct an exposure amount to be applied by an exposing unit to the pixel to be corrected on basis of the selected correction information piece from an exposure amount corresponding to the image data.

13 Claims, 11 Drawing Sheets

| DISTANCE FROM EDGE | TONER HEIGHT RATIO | REDUCTION RATIO OF EXPOSURE AMOUNT | |
|---|---|---|---|
| | | EXPOSURE INTENSITY | PWM |
| 1 | 0.87 | -0.13 | 0 |
| 2 | 1.25 | 0.25 | 0.25 |
| 3 | 1.5 | 0.5 | 0.5 |
| 4 | 1.25 | 0.25 | 0.25 |
| 5 | 1.125 | 0.125 | 0.125 |

| DISTANCE FROM EDGE | TONER HEIGHT RATIO | REDUCTION RATIO OF EXPOSURE AMOUNT | |
|---|---|---|---|
| | | EXPOSURE INTENSITY | PWM |
| 1 | 0.91 | -0.09 | 0 |
| 2 | 1.4 | 0.4 | 0.4 |
| 3 | 1.64 | 0.64 | 0.64 |
| 4 | 1.4 | 0.4 | 0.4 |
| 5 | 1.225 | 0.225 | 0.225 |

FIG. 9

A

| | | | | | | | | | | | | | | | |
|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 |
| 1 | 2 | 2 | 2 | 2 | 2 | 2 | 2 | 2 | 2 | 2 | 2 | 2 | 2 | 2 | 1 |
| 1 | 2 | 3 | 3 | 3 | 3 | 3 | 3 | 3 | 3 | 3 | 3 | 3 | 3 | 2 | 1 |
| 1 | 2 | 3 | 4 | 4 | 4 | 4 | 4 | 4 | 4 | 4 | 4 | 4 | 3 | 2 | 1 |
| 1 | 2 | 3 | 4 | 5 | 5 | 5 | 5 | 5 | 5 | 5 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 0 | 0 | 0 | 0 | 0 | 0 | 5 | 4 | 3 | 2 | 1 |
| 1 | 2 | 3 | 4 | 5 | 5 | 5 | 5 | 5 | 5 | 5 | 5 | 4 | 3 | 2 | 1 |
| 1 | 2 | 3 | 4 | 4 | 4 | 4 | 4 | 4 | 4 | 4 | 4 | 4 | 3 | 2 | 1 |
| 1 | 2 | 3 | 3 | 3 | 3 | 3 | 3 | 3 | 3 | 3 | 3 | 3 | 3 | 2 | 1 |
| 1 | 2 | 2 | 2 | 2 | 2 | 2 | 2 | 2 | 2 | 2 | 2 | 2 | 2 | 2 | 1 |
| 1 | 1 | 1 | 1 | 1 | 1 | 1 | 1 | 1 | 1 | 1 | 1 | 1 | 1 | 1 | 1 |

500

FIG. 11A

| DISTANCE FROM EDGE | TONER HEIGHT RATIO | REDUCTION RATIO OF EXPOSURE AMOUNT | |
|---|---|---|---|
| | | EXPOSURE INTENSITY | PWM |
| 1 | 0.87 | -0.13 | 0 |
| 2 | 1.25 | 0.25 | 0.25 |
| 3 | 1.5 | 0.5 | 0.5 |
| 4 | 1.25 | 0.25 | 0.25 |
| 5 | 1.125 | 0.125 | 0.125 |

FIG. 11B

| DISTANCE FROM EDGE | TONER HEIGHT RATIO | REDUCTION RATIO OF EXPOSURE AMOUNT | |
|---|---|---|---|
| | | EXPOSURE INTENSITY | PWM |
| 1 | 0.91 | -0.09 | 0 |
| 2 | 1.4 | 0.4 | 0.4 |
| 3 | 1.64 | 0.64 | 0.64 |
| 4 | 1.4 | 0.4 | 0.4 |
| 5 | 1.225 | 0.225 | 0.225 |

FIG. 12

| | | | | |
|---|---|---|---|---|
| B5 | A4 | A3 | A2 | A1 |
| B4 | B4 | A3 | A2 | A1 |
| B3 | B3 | B3 | A2 | A1 |
| B2 | B2 | B2 | B2 | A1 |
| B1 | B1 | B1 | B1 | B1 |

500

A

FIG. 13

| | | | | |
|---|---|---|---|---|
| 5, 5 | 4, 5 | 3, 5 | 2, 5 | 1, 5 |
| 5, 4 | 4, 4 | 3, 4 | 2, 4 | 1, 4 |
| 5, 3 | 4, 3 | 3, 3 | 2, 3 | 1, 3 |
| 5, 2 | 4, 2 | 3, 2 | 2, 2 | 1, 2 |
| 5, 1 | 4, 1 | 3, 1 | 2, 1 | 1, 1 |

500

A

FIG. 14A

| | | | | |
|---|---|---|---|---|
| 1.18 | 1.24 | 1.36 | 1.24 | 1.05 |
| 1.26 | 1.33 | 1.45 | 1.33 | 1.13 |
| 1.38 | 1.45 | 1.57 | 1.45 | 1.25 |
| 1.26 | 1.33 | 1.45 | 1.33 | 1.13 |
| 1.02 | 1.08 | 1.21 | 1.08 | 0.89 |

500

A

FIG. 14B

| | | | | |
|---|---|---|---|---|
| 0.18 | 0.24 | 0.36 | 0.24 | 0.05 |
| 0.26 | 0.33 | 0.45 | 0.33 | 0.13 |
| 0.38 | 0.45 | 0.57 | 0.45 | 0.25 |
| 0.26 | 0.33 | 0.45 | 0.33 | 0.13 |
| 0.02 | 0.08 | 0.21 | 0.08 | 0.00 |

500

A

IMAGE FORMING APPARATUS AND IMAGE PROCESSING APPARATUS

BACKGROUND

Field of the Disclosure

The present disclosure relates to a technology for adjusting an exposure amount for a pixel for image formation.

Description of the Related Art

In recent years, printing by using an electrophotography image forming apparatuses has widely spread, and achieving a uniform density on a printed image and reducing the consumed amount of toner have been demanded. Japanese Patent Laid-Open No. 2014-165776 discloses a configuration which identifies a character part and an edge part thereof within an image and performs gamma correction on a density difference between the edge part and the remaining part. Japanese Patent Laid-Open No. 2000-043315 discloses a configuration which, in a case where adjacent image regions are different in density, corrects a change in density occurring in a boundary part between the image regions on basis of densities of pixels after image processing is performed.

On the other hand, an image forming apparatus may cause an edge effect which increases the density of an edge part of an image region.

Applying the configuration disclosed in Japanese Patent Laid-Open No. 2014-165776 or Japanese Patent Laid-Open No. 2000-043315 to an edge effect for performing a toner reduction process on basis of a higher density may excessively reduce the exposure amount and excessively reduce the amount of toner. On the other hand, performing a toner reduction process on basis of a lower density may cause insufficient reduction of the exposure amount and may possibly not suppress the edge effect effectively.

The present invention provides an image forming apparatus and an image processing apparatus for properly adjusting the exposure amount of pixels.

SUMMARY

According to an aspect of the present disclosure, an image forming apparatus includes a photosensitive member, an exposing unit configured to expose the photosensitive member with light to form an electrostatic latent image, an identifying unit configured to identify, on basis of image data, a pixel to be corrected from a plurality of pixels of an image to be formed from the image data, a holding unit configured to hold a plurality of correction information pieces describing correction amounts for exposure amounts, and a correcting unit configured to select a correction information piece from the plurality of correction information pieces on basis of distances between one of the pixels to be corrected and a plurality of edges of the image formed from the image data and to correct an exposure amount to be applied by the exposing unit to the pixel to be corrected on basis of the selected correction information piece from an exposure amount corresponding to the image data.

Further features of the present disclosure will become apparent from the following description of exemplary embodiments with reference to the attached drawings.

BRIEF DESCRIPTION OF THE DRAWINGS

FIG. 9 illustrates pixels to be corrected according to an embodiment.

FIGS. 11A and 11B illustrate exposure-amount adjustment parameters according to an embodiment.

FIG. 12 is an explanatory diagram illustrating an exposure-amount adjusting method for pixels to be corrected according to an embodiment.

FIG. 13 illustrates distances from an edge to pixels to be corrected according to an embodiment.

FIGS. 14A and 14B are explanatory diagrams illustrating an exposure-amount adjusting method for pixels to be corrected according to an embodiment.

DESCRIPTION OF THE EMBODIMENTS

Illustrative embodiments of the present invention will be described below with reference to drawings. The following embodiments are given for illustration purpose and are not intended to limit details of embodiments of the present invention. Components that are not necessary for describing embodiments are not illustrated in drawings.

First Embodiment

Figure 1:
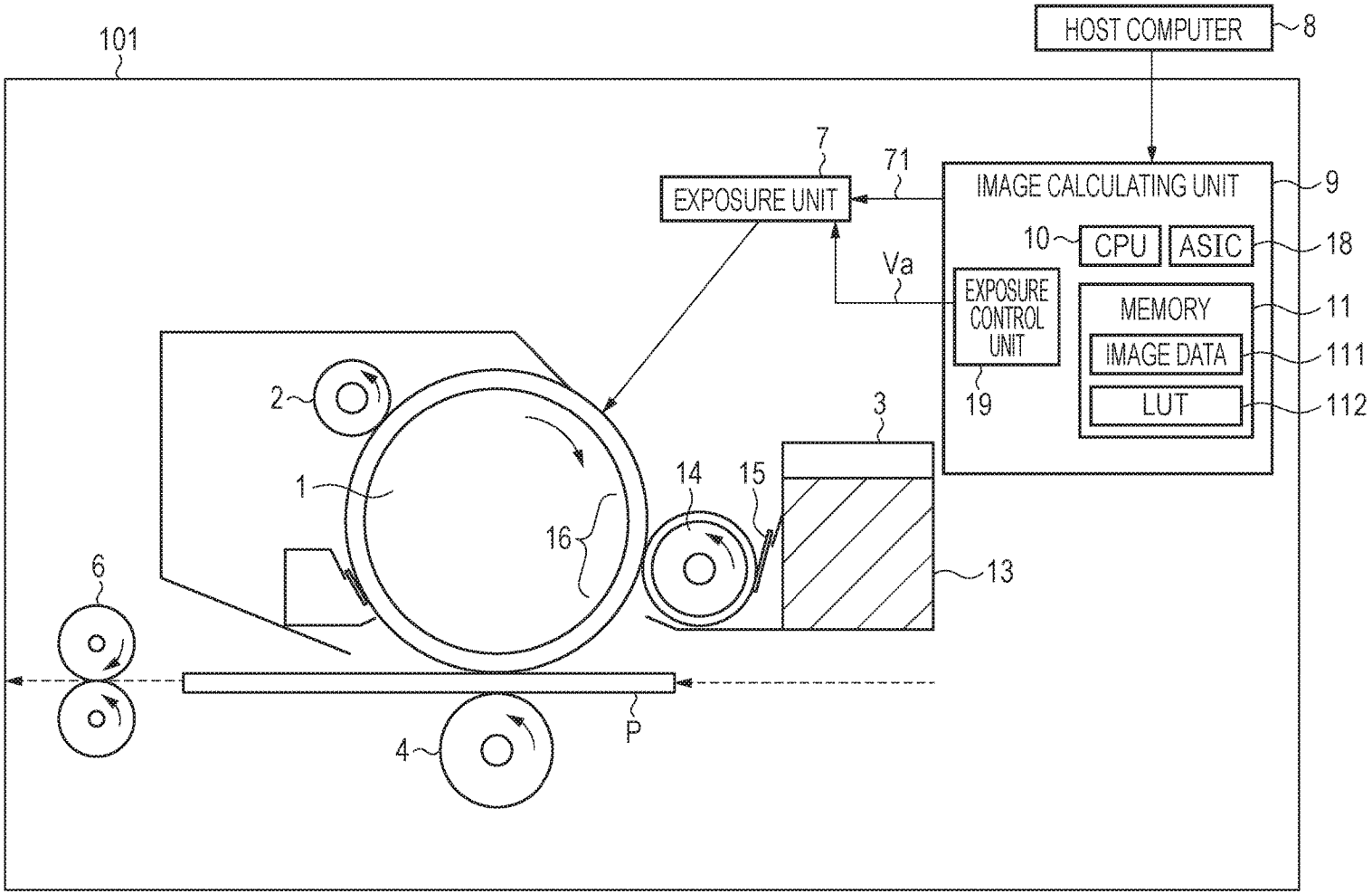
FIG. 1 is a configuration diagram of an image forming apparatus according to an embodiment.

FIG. 1 is a configuration diagram illustrating an image forming apparatus 101 according to this embodiment. A photosensitive member 1 being an image bearing member is driven to rotate in a direction indicated by an illustrated arrow for image formation. A charging unit 2 electrostatically charges a surface of the photosensitive member 1 to an even electric potential. An exposing unit 7 exposes the electrostatically charged surface of the photosensitive member 1 with light based on image data for forming an electrostatic latent image on the photosensitive member 1. The exposing unit 7 is driven in response to a drive signal 71 output from an image calculating unit 9. An exposure control unit 19 in the image calculating unit 9 adjusts such that the exposure intensity achieved by the exposing unit 7 with voltage Va can be equal to a target value.

A developing unit 3 includes a container 13 configured to store toner being a developing agent and a developing roller 14. The toner may be nonmagnetic single-component toner, two-component toner, or magnetic toner. A regulating blade 15 is provided which is configured to regulate the layer thickness of toner supplied to the developing roller 14 to a predetermined value. The regulating blade 15 may be configured to give electric carriers to toner. The toner is conveyed by a developing roller 14 to a development region 16. The development region 16 refers to a region where the developing roller 14 and the photosensitive member 1 are in proximity to or in contact with each other for adhering toner to an electrostatic latent image. The developing unit 3 adheres toner to an electrostatic latent image formed on the photosensitive member 1 to visualize it as a toner image. A transfer printing unit 4 performs transfer printing on the toner image formed on the photosensitive member 1 formed on a printing material P. A fixing unit 6 applies heat and pressure to the printing material P to fix, to the printing material P, the toner image having undergone transfer printing to the printing material P.

The CPU 10 in the image calculating unit 9 is a control unit configured to generally control over the image forming apparatus 101. According to an embodiment of the present invention, the overall control, which will be described below, may not be performed by the CPU 10, but a part thereof may be performed by an ASIC 18. Alternatively, the overall control, which will be described below, may be performed by the ASIC 18. A memory 11 is a storage unit configured to store image data and hold an LUT 112. The LUT 112 is a lookup table containing correction width parameters and exposure-amount adjustment parameters. The image calculating unit 9 receives image data transmitted from a host computer 8, suppresses influence of an edge effect on basis of the correction width parameters and exposure-amount adjustment parameters held in the LUT 112, and corrects the image data to reduce the toner consumed amount.

Figure 2:
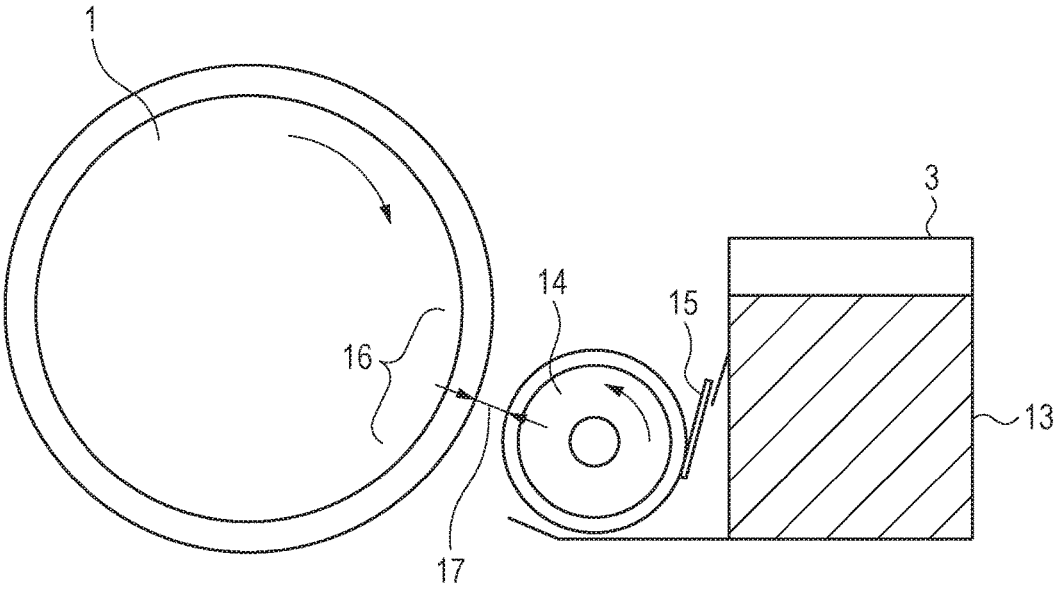
FIG. 2 is an explanatory diagram of a developing method according to an embodiment.

Next, a development system in the developing unit 3 will be described with reference to FIG. 2. According to this embodiment, a toner projection development system is applied as a developing method. According to the toner projection development system, the developing roller 14 and the photosensitive member 1 are not in contact with each other, but a gap 17 having a predetermined distance is provided therebetween. An AC bias on which a direct current bias is superimposed is used as a developing bias to be output from the developing roller 14.

Figure 3:
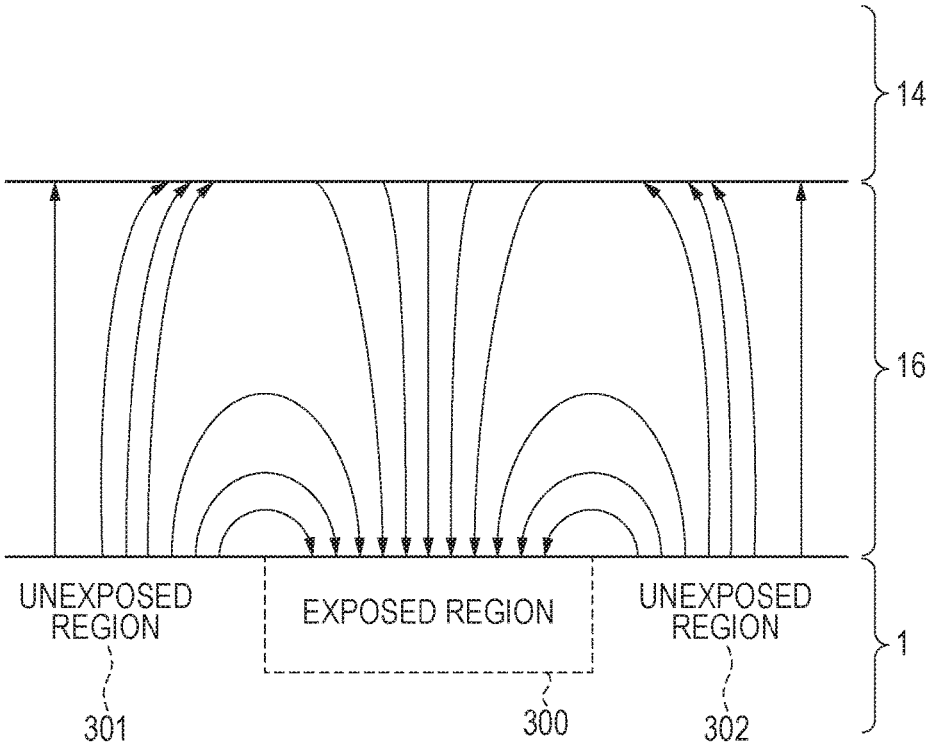
FIG. 3 is an explanatory diagram for a principle of occurrence of an edge effect.

Next, a principle of occurrence of an edge effect in an edge part where an increased amount of toner is adhered to an electrostatic latent image will be described. The edge effect here refers to a phenomenon that an intensified electric field on an electrostatic latent image formed on the photosensitive member 1, that is, at a boundary between an exposed region and the other unexposed region causes toner to be excessively adhered to an edge of the electrostatic latent image. It is assumed here, for example, that an image to be formed has a uniform density. As illustrated in FIG. 3, electric lines of force from the unexposed regions 301 and 302 surrounding the exposed region 300 go round the edges of the exposed region 300 so that the intensity of the electric fields in the electric fields can be higher than the other part of exposed region 300. Thus, more toner may be adhered to the edges of the exposed region 300 compared to the other part.

Figure 4A:
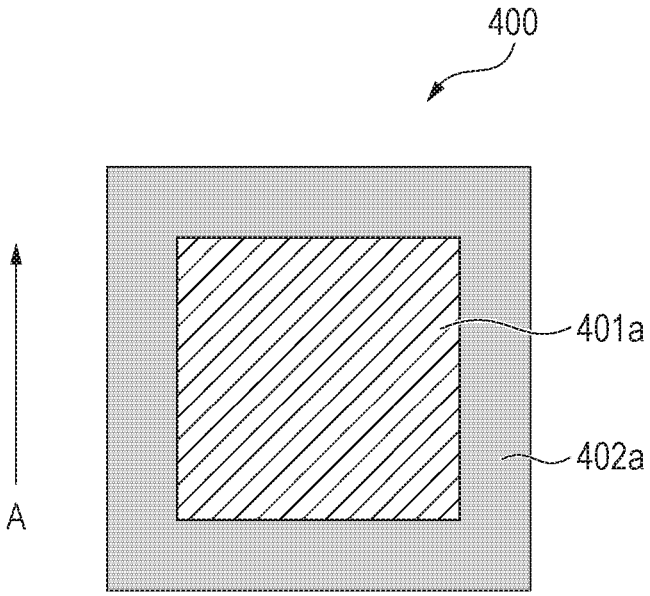
FIGS. 4A and 4B illustrate images having an edge effect.
Figure 4B:
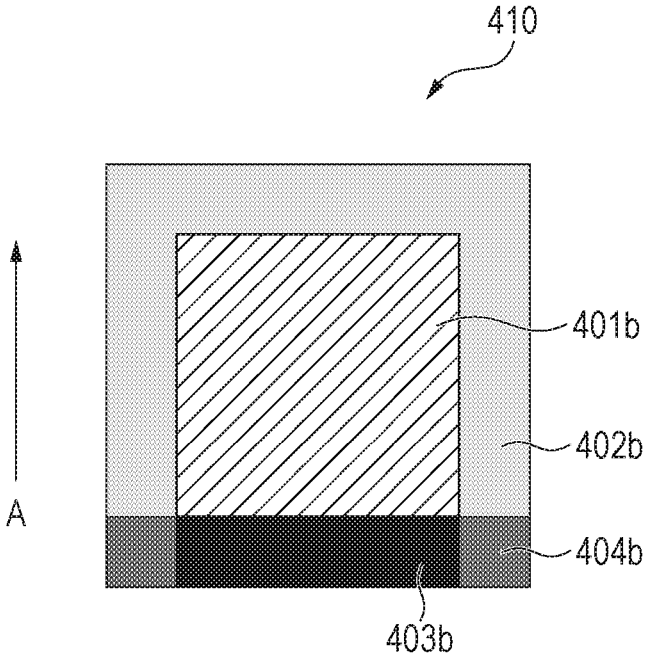

FIG. 4A illustrates a toner image 400 having an edge effect. FIG. 4A illustrates an arrow A indicating a conveying direction of a toner image, that is, the rotational direction of the photosensitive member 1. The image data on which the toner image 400 is based have equal pixel values as a whole, that is, the toner image 400 has a uniform density. In a case where an edge effect occurs thereon, toner is intensively adhered to an edge region 402*a* of the toner image 400. As a result, the edge region 402*a* has a density higher than the density of a non-edge region 401*a*. Changes in density due to an edge effect may differ between edges. In a toner image 410 illustrated in FIG. 4B, an edge region 403*b* on a rear end side in the rotational direction has a density higher than the density the remaining edge region 402*b*. Due to an edge effect, the edge region 402*b* has a density higher than the density of a non-edge region 401*b*. As illustrated in FIG. 4B, in a case where the strength of the edge effect differs between edges, an intersection region 404*b* has an intermediate density between the density of the edge region 403*b* and the density of the edge region 402*b*. The term "intersection region" refers to a region where edge regions having edge effects of different strengths intersect each other.

Figure 5:
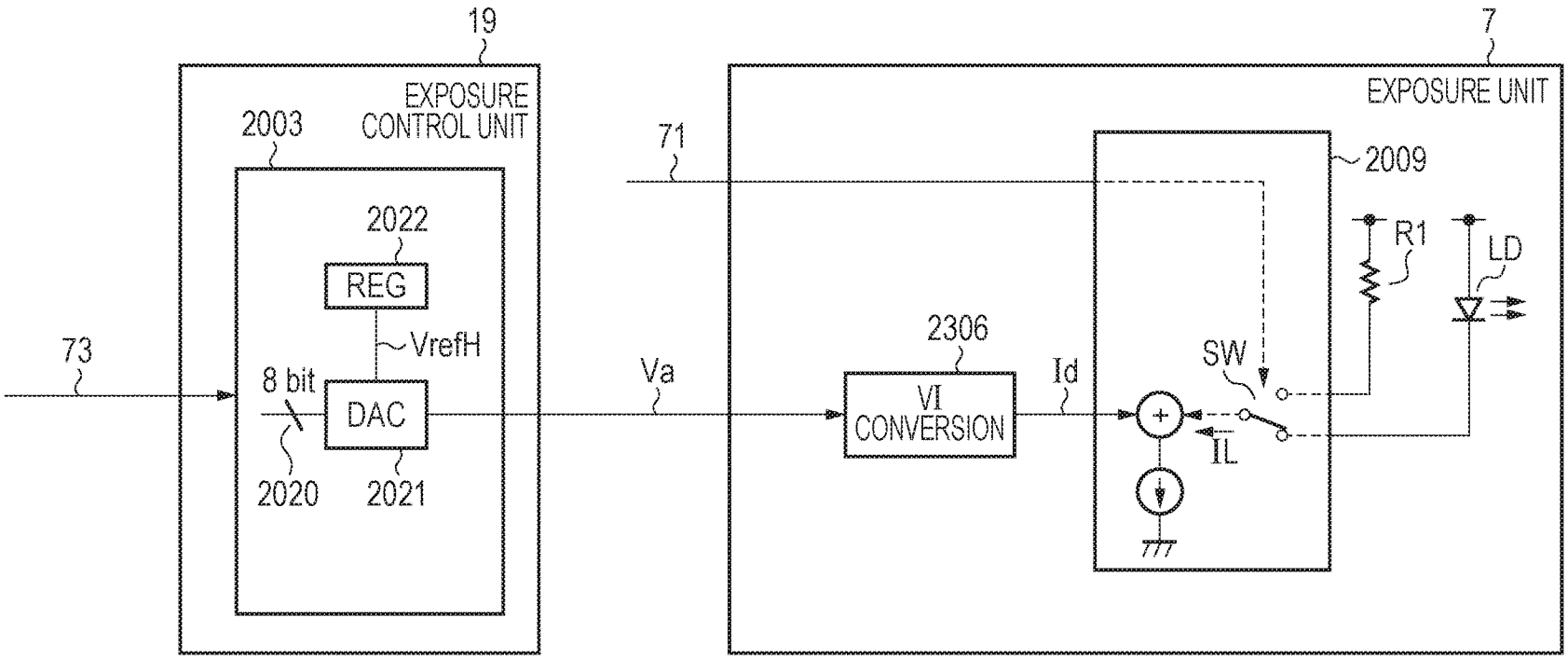
FIG. 5 illustrates a configuration of control over an exposure amount according to an embodiment.

FIG. 5 illustrates a control configuration of the exposing unit 7. The exposure control unit 19 has an IC 2003 including an 8-bit DA converter (DAC) 2021 and a regulator (REG) 2022. The IC 2003 adjusts voltage VrefH output from the regulator 2022 on basis of an intensity adjustment signal 73 set by the CPU 10. The voltage VrefH is a reference voltage for the DA converter 2021. The IC 2003 sets input data 2020 for the DA converter 2021 so that the DA converter 2021 outputs a voltage Va to the exposing unit 7. A VI conversion circuit 2306 in the exposing unit 7 converts the voltage Va to an electric current value Id and outputs it to a driver IC 2009. The driver IC 2009 controls the exposure intensity of the exposing unit 7 on basis of the electric current value Id. In other words, the exposure control unit 19 can control the exposure intensity of the exposing unit 7 on basis of the voltage Va. The driver IC 2009 further turns a switch (SW) for the driver IC 2009 in accordance with a drive signal 71 output from the image calculating unit 9. The SW is turned to select whether electric current IL is to be fed to a laser diode (LD) of the exposing unit 7 or to a dummy resistance R1 for ON/OFF control over the light emission to be performed by the LD.

Figure 6A:
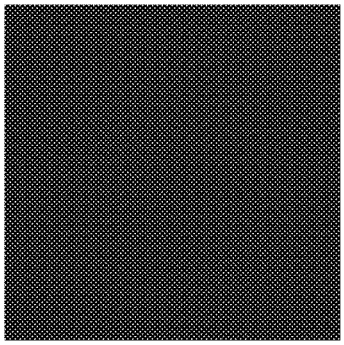
FIGS. 6A to 6C are explanatory diagrams illustrating a control method over an exposure amount according to an embodiment.
Figure 6B:
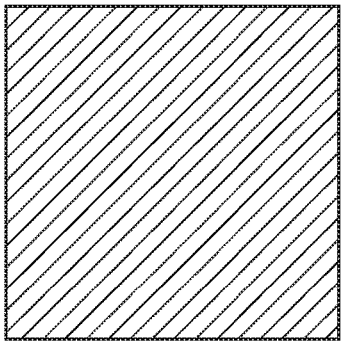
Figure 6C:
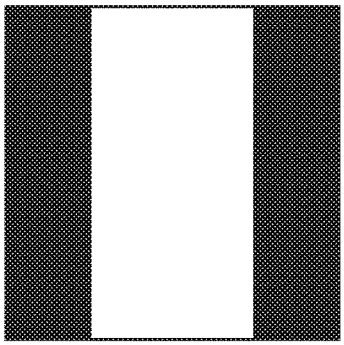

Next, a method for controlling the exposure amount of a pixel will be described. FIG. 6A illustrates a state acquired by exposing a whole region of one pixel with light with 100% intensity of a predetermined target intensity. FIGS. 6B and 6C illustrate pixels having a substantially half density of that of the pixel in FIG. 6A. The pixel in FIG. 6B has a state acquired by exposing a whole region of one pixel with light with 50% intensity of the predetermined target intensity. The exposure intensity here is controlled with voltage Va output from the exposure control unit 19 to the exposing unit 6, as described with reference to FIGS. 6A to 6C. FIG. 6C illustrates a state of one pixel divided into four sub pixels acquired by exposing two of the sub pixels with light with 100% intensity of the predetermined target intensity. This may be achieved by setting voltage Va such that the exposure intensity can be equal to a target intensity and turning on/off the SW in response to the drive signal 71 in the control configuration in FIG. 5. In this case, the drive signal 71 is a PWM (pulse width modulation) signal.

Figure 7:
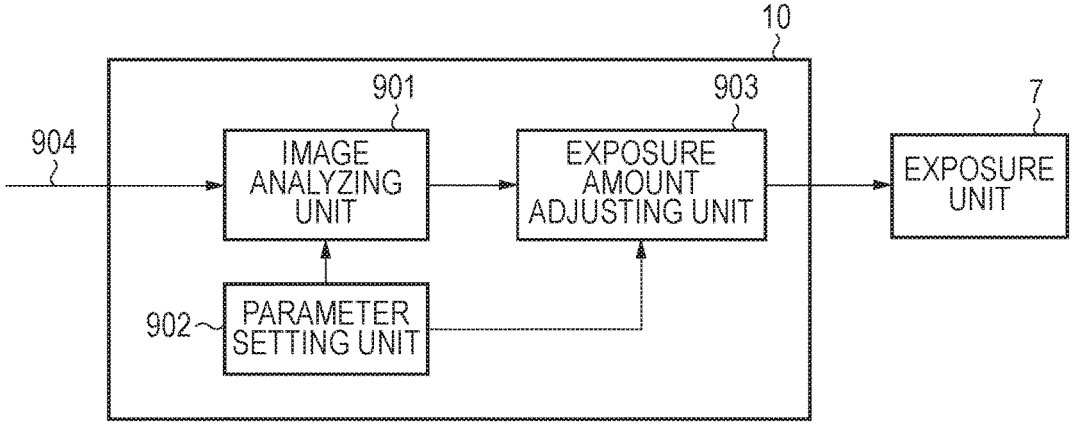
FIG. 7 is a functional block diagram illustrating a CPU for controlling an exposure amount according to an embodiment.

FIG. 7 illustrates functional blocks in the CPU 10 for suppressing an edge effect. According to this embodiment, the CPU 10 is configured to perform processing for suppressing an edge effect. However, as already described above, the processing may be performed in cooperation with the ASIC 18 or by the ASIC 18 alone. The parameter setting unit 902 notifies and sets a correction width parameter on the LUT 112 to and in the image analyzing unit 901. The parameter setting unit 902 notifies and sets an exposure-amount adjustment parameter on the LUT 112 to and in the exposure amount adjusting unit 903. The image data 904 transmitted from the host computer 8 are stored in the memory 11 illustrated in FIG. 1. The image analyzing unit 901 identifies, as a pixel to be corrected, a pixel at which an edge effect may possibly occur from pixels of an image formed from the image data 904 on basis of the correction width parameter and notifies the pixel to be corrected to the exposure amount adjusting unit 903. The exposure amount adjusting unit 903 corrects the pixel value of the pixel to be corrected, which is identified by the image analyzing unit 901, on basis of the exposure-amount adjustment parameter to generate corrected image data. The exposing unit 7 is controlled on basis of the corrected image data. The correction width parameter is information describing a pixel having an edge effect and, according to this embodiment, is information describing a range of pixels at which an edge effect may possibly occur by using a distance from an edge or, in this example, the number of pixels from the edge. For example, when the correction width parameter is "5", it is determined that an edge effect may occur at the five pixels from an edge. According to this embodiment, a pixel to be corrected is not identified in a direction of a width having a number of pixels lower than a value of the correction width parameter. The exposure-amount adjustment parameter is correction information describing a correction amount for an exposure amount corresponding to image data. The correction width parameters and the exposure-amount adjustment parameters are acquired in advance through experiments and simulations. Methods which adjusts an exposure amount of a pixel may include, as illustrated in FIGS. 6B and 6C, a method which adjusts the exposure intensity and a method which changes the number of sub pixels to be exposed in response to a PWM signal without changing the exposure intensity. Alternatively, the exposure intensity may be changed, and the number of sub pixels to be exposed in response to a PWM signal may then be changed.

Figure 8:
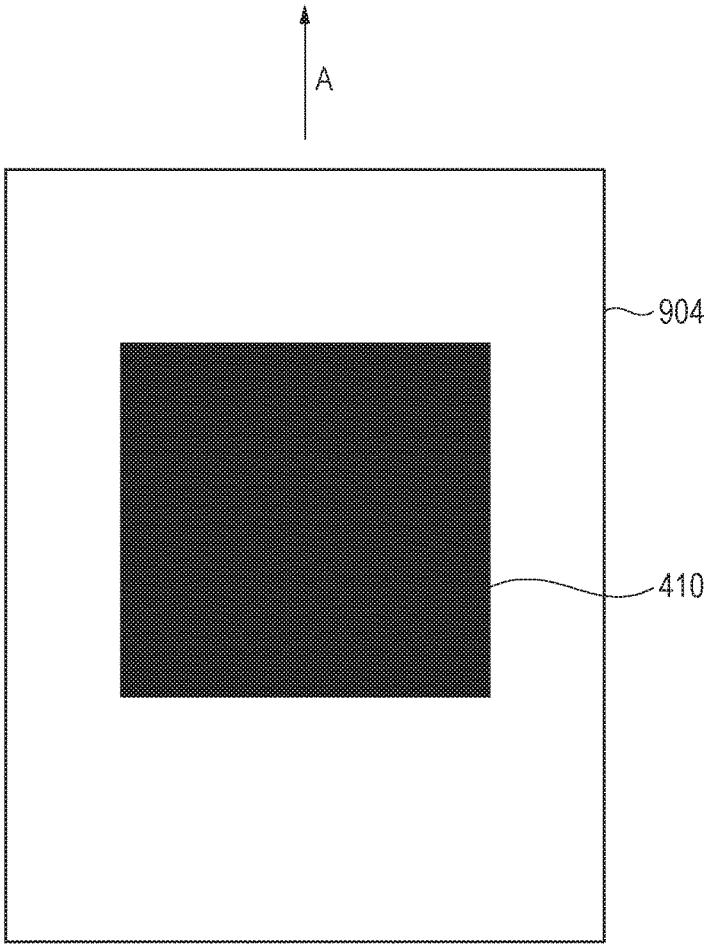
FIG. 8 illustrates an image according to an embodiment.

Next, processing will be described which is to be performed by the image analyzing unit 901 for suppressing an edge effect. FIG. 8 illustrates an image 410 formed on one printing material 904 on basis of image data. FIG. 8 illustrates an arrow A indicating a rotational direction or a sub scanning direction of the photosensitive member 1. According to this embodiment, a region having a series of pixels to which toner is adhered is handled as one image 410. Referring to FIG. 8, all pixels of the image 410 have a pixel value "255", and all pixels of the remaining region of the printing material have a pixel value "0". The pixel value "255" corresponds to black color while the pixel value "0" corresponds to white color, that is, pixels to which toner is not to be adhered. FIG. 9 illustrates pixels of the image 410 identified by the image analyzing unit 901 as pixels to be corrected in a case where correction width parameter is "5". FIG. 9 illustrates an arrow A indicating the rotational direction of the photosensitive member 1. Referring to FIG. 9, numbers "1" through "5" indicate pixels to be corrected, and a number "0" indicates pixels that are not to be corrected. The numbers "1" through "5" of pixels to be corrected indicate lowest values of distances from an edge. The image analyzing unit 901 notifies the exposure amount adjusting unit 903 of pixels to be corrected and distances from an edge as illustrated in FIG. 9.

Figure 10A:
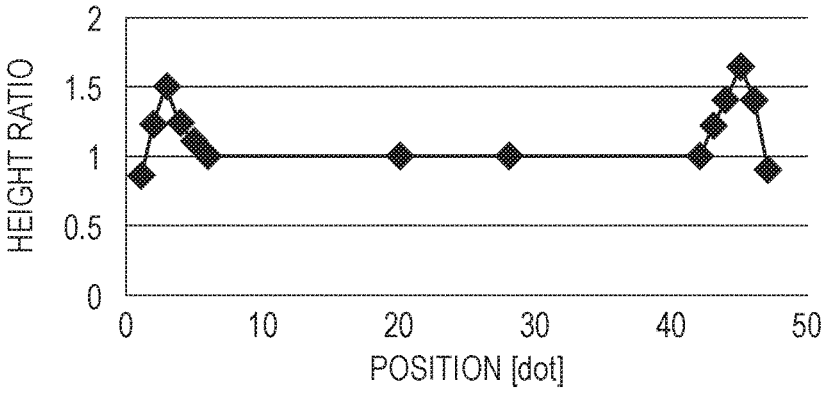
FIGS. 10A to 10C are explanatory diagrams of corrections against an edge effect according to an embodiment.
Figure 10B:
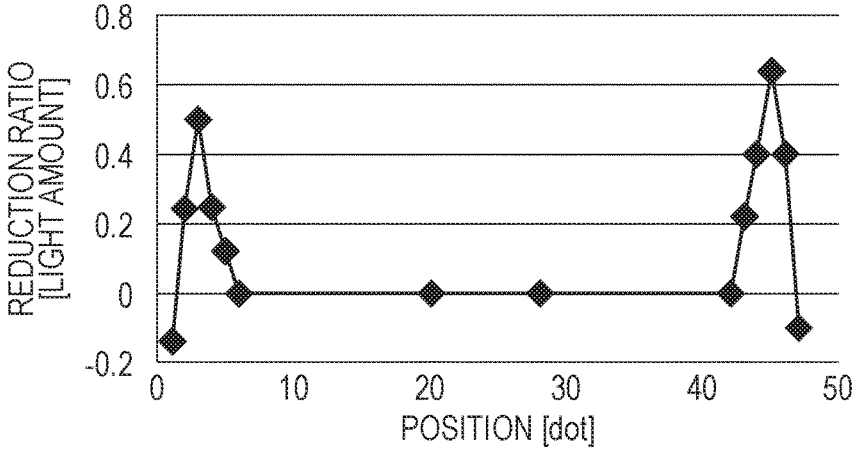
Figure 10C:
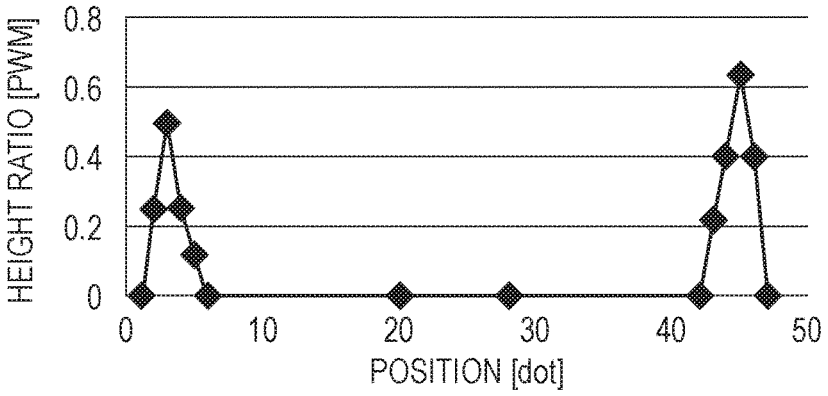

FIG. 10A illustrates, along the sub scanning direction, heights of toner at a center in a main scanning direction of the image 410 having an edge effect. The main scanning direction is a direction orthogonal to the sub scanning direction. Referring to FIG. 10A, heights of pixels without an edge effect are normalized to "1". FIG. 10B illustrates a reduction ratio of the height of toner in a case where the height of toner at all pixels in FIG. 10A is "1". As illustrated in FIG. 10A, the exposure amount for a pixel having a height of toner larger than 1 is reduced, and the exposure amount for a pixel having height of toner smaller than 1 is increased. FIG. 10C illustrates a reduction ratio of the height of toner in a case where the height of a pixel larger than 1 in FIG. 10A is corrected to 1 while the height of a pixel smaller than 1 is not corrected. In a case where the correction is performed in accordance with a PWM signal, the height of toner of a pixel larger than 1 is only corrected as illustrated in FIG. 10C, for example.

FIGS. 11A and 11B illustrate exposure-amount adjustment parameters according to this embodiment. It is assumed here that, as illustrated in FIG. 4B, the edge effect occurring at a rear side edge in the rotational direction of the photosensitive member is stronger than an edge effect occurring at other edges. FIG. 11B illustrates exposure-amount adjustment parameters for the rear side edge in the rotational direction of the photosensitive member, and FIG. 11A illustrates exposure-amount adjustment parameters for other edges. In this example, the edge effect occurring at a rear side edge in the rotational direction of the photosensitive member is larger than an edge effect occurring at other edges. Therefore, the exposure-amount adjustment parameters in FIG. 11A or FIG. 11B are applied to pixels in an intersection region 500 in FIG. 9 under a rule illustrated in FIG. 12. Referring to FIG. 12, pixels indicated by references beginning with "A" are pixels to which the exposure-amount adjustment parameters in FIG. 11A are applied, and pixels indicated by references beginning with "B" are pixels to which the exposure-amount adjustment parameters in FIG. 11B are applied. Each of numbers subsequent to A or B indicates a distance from an edge. Under the rule in FIG. 12, an exposure-amount adjustment parameter corresponding to an edge at a shorter distance is applied. The exposure-amount adjustment parameters in FIG. 11B are applied to pixels on a diagonal line at an equal distance from two edges, but the exposure-amount adjustment parameters in FIG. 11A may be applied. Each of the exposure-amount adjustment parameters corresponds to correction information describing a correction amount for an exposure amount for adjusting the height of toner, that is, a correction amount for a pixel value. The exposure intensity in FIGS. 11A and 11B supports the method for adjusting an exposure amount based on an exposure intensity as described with reference to FIG. 6B, and the PWM supports the method for adjusting an exposure amount based on a PWM as described with reference to FIG. 6C. In the method based on a PWM, the reduction ratio for exposure amounts is equal to zero. In other words, the correction of an exposure amount includes no correction as a result. The exposure amount adjusting unit 903 corrects a pixel value (exposure amount) of each pixel to be corrected in accordance with the corresponding one of the exposure-amount adjustment parameters illustrated in FIGS. 11A and 11B. Then, the image calculating unit 9 controls the exposing unit 7 on basis of the corrected pixel value.

According to this embodiment, a pixel to be corrected is identified on basis of a correction width parameter, and the exposure amount or pixel value of the pixel to be corrected is corrected on basis of an exposure-amount adjustment parameter. Here, the correction width parameter is information describing a pixel to be corrected by using a range of distance from an edge of an image. According to this embodiment, for example, if the correction width parameter is "5", the first to fifth pixels of an image in the main scanning direction and sub scanning direction are identified as pixels to be corrected where the first pixel is a pixel at an edge of the image. Two values such as "2" and "5" may be used as the correction width parameters. In this case, the second to fifth pixels in an image in the main scanning direction and sub scanning direction are identified as pixels to be corrected where the first pixel is a pixel at an edge of the image. Therefore, the image analyzing unit 901 identifies a pixel of an image within a predetermined range of distance from an edge of the image as a pixel to be corrected. The predetermined range is indicated by the correction width parameter.

According to this embodiment, a plurality of exposure-amount adjustment parameter being correction information is provided for use according to the strength of an occurring edge effect, and exposure-amount adjustment parameters are associated with edge types. The edge type of an edge of an image is discriminated on basis of the direction of the edge and an edge position on the image. For example, according to this embodiment, four edge types are defined including a front side edge of an image in the main scanning direction, a rear side edge of the image in the main scanning direction, a right side edge of the image in the sub scanning direction, and a left side edge of the image in the sub scanning direction. The front side, rear side, right side, and left side here refer to positions in the moving direction of a surface of the photosensitive member where the side having a first edge in the main scanning direction (or downstream side in the moving direction of the surface of the photosensitive member) is the front side. In other words, referring to FIG. 4B, the edge region 403*b* having a stronger edge effect is the rear side edge of the image in the main scanning direction. The opposite edge region to the edge region 403*b* is the front side edge in the main scanning direction. The left side region to the edge region 403*b* is the left side edge in the sub scanning direction, and the right side region to the edge region 403*b* is the right side edge in the sub scanning direction. In a case where the edge type of an edge that is the closest to a pixel to be corrected of an image is the front side edge of the image in the main scanning direction or the left side or right side edge in the sub scanning direction of the image, the correction information in FIG. 11A is selected for use. On the other hand, in a case where the edge type of an edge that is the closest to a pixel to be corrected of an image is the rear side edge of the image in the main scanning direction, the correction information in FIG. 11B is selected for use. Though the direction of an edge is not precisely matched with the main scanning direction and the sub scanning direction in general, the closest one is identified from the four edge types on basis of the position of the edge on an image and the direction of the edge, and the identified edge type is determined as the edge type of the edge. In a case where the edge is curved, the edge may be divided into a plurality of sections so that the edge type can be determined for each of the sections. Having described that each edge type is identified with two directions according to this embodiment, an edge type may be provided for each predetermined angle about the main scanning direction, for example. The memory 11 holds information describing which exposure-amount adjustment parameter is to be used in accordance with an identified edge type, and the CPU 10 corrects a pixel to be corrected on basis of the exposure-amount adjustment parameter corresponding to the edge type of a closest edge. In a case where a plurality of edges exists at an equal closest distance, which exposure-amount adjustment parameter is to be used may be determined arbitrarily. With this configuration, the exposure amount of pixels to which toner is excessively adhered due to an edge effect on an image can be adjusted properly, and the image quality of edge regions of the image can be maintained.

According to this embodiment, if the number of serial pixels in an image region is equal to or lower than a correction width parameter, the identification of a pixel to be corrected is not performed in a direction of the serial pixels. However, other kinds of values may be defined as the threshold value instead of the correction width parameter. In other words, if a length in the main scanning direction or the sub scanning direction is equal to or lower than a threshold value, the identification of a pixel to be corrected is not performed in the direction where the length is equal to or lower than the threshold value. In a case where a plurality of edges exists in a range within a correction width parameter from a pixel to be corrected and where the plurality of edges has a plurality of edge types, the edge type of the closest edge is used to determine the exposure-amount adjustment parameter according to this embodiment. Alternatively, priority levels may be given to edge types, and an exposure-amount adjustment parameter corresponding to the edge type with the highest priority level among the edge types of a plurality of edges may be used for a pixel to be corrected within a correction width parameter from the plurality of edges.

Second Embodiment

Next, a second embodiment will be described with focus of differences from the first embodiment. According to the first embodiment, the correction amount for the exposure amount of a pixel to be corrected within a correction width parameter from a plurality of edges is determined by using the exposure-amount adjustment parameter corresponding to the edge type of the closest edge or the edge type with the highest priority level. According to this embodiment, all exposure-amount adjustment parameters corresponding to the edge types of a plurality of edges are used for a pixel to be corrected within a correction width parameter from the plurality of edges.

First, like the first embodiment, assuming that the correction width parameter is "5", and the exposure-amount adjustment parameters in FIG. 11A are used for all edges in the main scanning direction and a front side edge in the sub scanning direction, and the exposure-amount adjustment parameters in FIG. 11B are used for a rear side edge in the sub scanning direction. FIG. 13 illustrates distances from two edges of pixels to be corrected within the intersection region 500 in FIG. 9. Referring to FIG. 13, each of numbers on the left side indicates a distance from a right side edge in the sub scanning direction, and each of the numbers on the right side indicates a distance from a rear side edge in the main scanning direction.

According to this embodiment, a height ratio T(i, j) of toner of a pixel to be corrected within the intersection region 500 can be calculated by the following expression (1).

$$T(i,j)=(r*R(i)+b*B(j))/n \quad (1)$$

where i is a distance from the right side edge in the sub scanning direction, and j is a distance from the rear side edge in the main scanning direction.

In this case, R(i) is a ratio of toner height of an ith pixel to be corrected from the right side edge in the sub scanning direction and is a value indicated by the exposure-amount adjustment parameter illustrated in FIG. 11A. B(j) is a ratio of a toner height of a jth pixel to be corrected from the rear side edge in the sub scanning direction and is a value indicated by the exposure-amount adjustment parameter in FIG. 11B. r and b are weighting factors indicating influences on a pixel to be corrected from the right side edge in the sub scanning direction and from the rear side edge in the sub scanning direction. n is a number of edges within the correction width parameter from a pixel to be corrected and is equal to 2 in this example.

For example, for a pixel at i=2 and j=4, R(2) and B(4) are 1.25 and 1.4, respectively, from FIGS. 11A and 11B. When r and b are 1, T(i, j) is 1.325. FIG. 14A illustrates height ration of toner of pixels where r and b are 1. Therefore, the reduction ration or the correction amounts for the exposure amount to correct by using a PWM may be given as illustrated in FIG. 14B. If n is equal to or higher than 3, the numerator of Expression (1) is equal to a value acquired by adding values of influenced edges, each acquired by multiplying a toner height ratio based on a distance from an edge by a weighting factor for the corresponding edge.

According to this embodiment, a weighting factor is preset for an edge type. For a pixel to be corrected subject to edge effects from a plurality of edges, the edge types of the plurality of edges are determined. In a case where a plurality of edge types exists, a correction amount for the exposure amount of a pixel to be corrected is calculated by weighting, with the corresponding weighting factor, correction amounts on an exposure-amount adjustment table corresponding to the plurality of edge types. According to this embodiment, the weighting factors for edge types are fixed values. However, each of the weighting factors may be a value depending on a distance between a pixel to be corrected and an edge or a variable that changes in accordance with the distance from an edge. With this configuration, the exposure amount of pixels to which toner is excessively adhered due to an edge effect on an image can be adjusted properly, and the image quality of edge regions of the image can be maintained.

Other Embodiments

The aforementioned embodiments apply the image forming apparatus 101. However, the present invention may be implemented by an image processing apparatus which supplies corrected image data to an image forming apparatus. The image processing apparatus has the image calculating unit 9 illustrated in FIG. 1 and generates image data corrected by adjusting the corresponding exposure amount as described above. The image processing apparatus supplies the generated image data to the image forming apparatus as output image data instead of the exposing unit 7.

The present invention may be implemented by processing including supplying a program implementing one or more functions of the aforementioned embodiments to a system or an apparatus over a network or a through a storage medium and causing one or more processors in a computer in the system or apparatus to read and execute the program. The present invention may further be implemented by a circuit (such as an ASIC) configured to implement one or more functions.

According to the present invention, the exposure amounts of pixels can be adjusted properly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-225088, filed Nov. 17, 2015, which is hereby incorporated by reference herein in its entirety.

What is claimed is:

1. An image forming apparatus comprising:

a photosensitive member;

an exposing unit configured to expose the photosensitive member with light to form an electrostatic latent image;

an identifying unit configured to identify, on basis of image data, a pixel to be corrected from a plurality of pixels of an image to be formed from the image data;

a holding unit configured to hold a plurality of correction information pieces describing correction amounts for exposure amounts; and a correcting unit configured to select a correction information piece from the plurality of correction information pieces on basis of distances between one of the pixels to be corrected and a plurality of edges of the image formed from the image data and to correct an exposure amount to be applied by the exposing unit to the pixel to be corrected on basis of the selected correction information piece from an exposure amount corresponding to the image data.

2. The image forming apparatus according to claim 1, wherein each of the plurality of correction information pieces corresponds to an edge type; and the correcting unit selects a correction information piece corresponding to an edge type of an edge at a shortest distance to the pixel to be corrected among edges of the image formed from the image data and corrects the exposure amount of the pixel to be corrected.

3. The image forming apparatus according to claim 1, wherein each of the plurality of correction information pieces corresponds to an edge type;

wherein the identifying unit identifies one of the pixels at a distance within a predetermined range to an edge of an image as the pixel to be corrected; and wherein the correcting unit selects correction information pieces corresponding to edge types of a plurality of edges of an image for a first pixel to be corrected at a distance within the predetermined range to the plurality of edges and corrects an exposure amount of the first pixel to be corrected.

4. The image forming apparatus according to claim 3, wherein, in a case where a plurality of edges at distances within the predetermined range to the first pixel to be corrected have a plurality of edge types, the correcting unit selects each correction information pieces corresponding to each edge types and corrects the exposure amount of the first pixel to be corrected on basis of the selected plurality of correction information pieces.

5. The image forming apparatus according to claim 4, wherein the correcting unit calculates a correction amount for the exposure amount of the first pixel to be corrected by weighting correction amounts described in the selected plurality of correction information pieces by a weighting factor.

6. The image forming apparatus according to claim 5, wherein the weighting factor for a correction information piece corresponding to an edge type of a first edge at a distance to the first pixel to be corrected within the predetermined range is determined on basis of the distance between the first pixel to be corrected and the first edge.

7. The image forming apparatus according to claim 1, wherein each of the plurality of correction information pieces corresponds to an edge type;

wherein a priority level is set for the edge type;

wherein the identifying unit identifies a pixel at a distance to an edge of the image within a predetermined range as a pixel to be corrected; and wherein, for a first pixel to be corrected at distances to a plurality of edges of the image within the predetermined range, the correcting unit selects a correction information piece corresponding to an edge type having a highest priority level among an edge types of the plurality of edge and corrects the exposure amount of the first pixel to be corrected.

8. The image forming apparatus according to claim 3, wherein the identifying unit identifies a pixel at a distance in the sub scanning direction or the main scanning direction to a pixel at an edge within the predetermined range as the pixel to be corrected.

9. The image forming apparatus according to claim 8, wherein, in a case where the image has a length in the sub scanning direction or the main scanning direction equal to or lower than a threshold value, the identifying unit does not identify the pixel to be corrected in the direction where the length is equal to or lower than the threshold value.

10. The image forming apparatus according to claim 2, wherein the edge type of an edge of the image is identified on basis of the direction of the edge or the position of the edge on the image.

11. The image forming apparatus according to claim 1, wherein the correcting unit divides the pixel to be corrected into a plurality of sub pixels and changes the number of sub pixels to be exposed to correct the exposure amount of the pixel to be corrected.

12. The image forming apparatus according to claim 1, wherein the correcting unit corrects the exposure amount of the pixel to be corrected by changing the exposure intensity to be applied by the exposing unit.

13. An image processing apparatus supplying output image data for forming an image to an image forming apparatus having a photosensitive member, and an exposing unit configured to expose the photosensitive member with light to form an electrostatic latent image, the image processing apparatus comprising:

an identifying unit configured to identify, on basis of image data, a pixel to be corrected among a plurality of pixels of an image to be formed from the image data;

a holding unit configured to hold a plurality of correction information pieces describing correction amounts for an exposure amount;

a correcting unit configured to select a correction information piece from the plurality of correction information pieces on basis of each distances between the pixel to be corrected and a plurality of edges of the image formed from the image data and to correct an exposure amount to be applied by the exposing unit to the pixel to be corrected on basis of the selected correction information piece from the exposure amount described in the image data to generate the output image data; and an output unit configured to output the output image data to the image forming apparatus.

* * * * *